US005383431A

United States Patent [19]

Nishimura et al.

[11] Patent Number: 5,383,431

[45] Date of Patent: Jan. 24, 1995

[54] ENGINE OUTPUT CHARACTERISTIC CONTROL SYSTEM FOR VEHICLE

[75] Inventors: Eiji Nishimura; Akiko Honda, both of Hiroshima, Japan

[73] Assignee: Mazda Motor Corporation, Hiroshima, Japan

[21] Appl. No.: 24,778

[22] Filed: Mar. 2, 1993

[30] Foreign Application Priority Data

Mar. 6, 1992 [JP] Japan ..... 4-49663

[51] Int. Cl.[6] ..... F02D 41/10

[52] U.S. Cl. ..... 123/399

[58] Field of Search ..... 123/352, 361, 399

[56] References Cited

U.S. PATENT DOCUMENTS

| | | | |
|---|---|---|---|
| 4,453,516 | 6/1984 | Filsinger | 123/399 X |
| 4,470,396 | 9/1984 | Hasumi et al. | 123/478 X |
| 4,671,235 | 6/1987 | Hosaka | 123/399 X |
| 4,691,677 | 9/1987 | Hotate et al. | 123/399 |
| 4,759,329 | 7/1988 | Nobuo et al. | 123/399 X |

FOREIGN PATENT DOCUMENTS

| | | | |
|---|---|---|---|
| 60-1335 | 1/1985 | Japan | 123/399 |
| 60-198342 | 10/1985 | Japan | 123/399 |
| 63-25347 | 2/1988 | Japan . | |
| 1-253548 | 10/1989 | Japan | 123/399 |
| 3-9047 | 1/1991 | Japan | 123/399 |

*Primary Examiner*—Tony M. Argenbright

*Attorney, Agent, or Firm*—Sixbey, Friedman, Leedom & Ferguson

[57] ABSTRACT

A throttle actuator opens and closes the throttle valve of an engine in response to movement of an accelerator pedal. Throttle opening characteristics which determines a target throttle opening for a given amount of depression of the accelerator pedal is set so that the accelerator depression fluctuation rate is minimized when the power mode is selected and so that the fuel consumption rate is minimized when the economy mode is selected.

16 Claims, 10 Drawing Sheets

ENGINE OUTPUT CHARACTERISTIC CONTROL SYSTEM FOR VEHICLE

BACKGROUND OF THE INVENTION

1. Field of the Invention

This invention relates to an engine output characteristic control system for a vehicle which controls the output characteristic versus the accelerator depression of an engine of the vehicle.

2. Description of the Prior Art

There has been proposed an electric throttle system in which the throttle valve is mechanically disconnected from the accelerator pedal and is electrically driven by an actuator such as an electric motor in response to depression of the accelerator pedal. In such an electric throttle system, the driver can select a power mode which emphasizes running performance or an economy mode which emphasizes fuel economy.

In accordance with a general control, when the power mode is selected, the gear-shift lines for the automatic transmission are shifted toward the higher vehicle speed side so that a lower gear speed is used and at the same time the throttle opening gain for a given accelerator depression (amount of depression of the accelerator pedal) is increased, while when the economy mode is selected, the gear-shift lines for the automatic transmission are shifted toward the lower vehicle speed side so that a higher gear speed is used and at the same time the throttle opening gain for a given accelerator depression is reduced.

In accordance with an equi-power line control which is effected on the basis of the fuel efficiency for equi-power lines, when the power mode is selected, the gear-shift lines are shifted toward the higher vehicle speed side so that a lower gear speed is used and at the same time the throttle opening gain for a given accelerator depression is reduced, thereby improving the engine response without changing the power, while when the economy mode is selected, the gear-shift lines are shifted toward the lower vehicle speed side so that a higher gear speed is used and at the same time the throttle opening gain for a given accelerator depression is increased, thereby using a lower engine speed range without changing the power so that the fuel efficiency is improved.

In the throttle control system disclosed in Japanese Unexamined Patent Publication No. 63(1988)-25347, the throttle valve is controlled so that the fuel consumption is minimized when the accelerator depression is smaller than a preset value, thereby improving the fuel economy while, when the accelerator depression is not smaller than the preset value, the throttle valve is controlled to correspond to the accelerator depression, thereby improving the running performance.

However the gear-shift maps for the power mode and the economy mode are conventionally set to conform to the greatest common factors of the needs of users and the traffic at the time the vehicle is developed, and accordingly they cannot give an optimal fuel consumption depending on the driver's habit in driving the vehicle and/or the traffic.

For example, when the throttle gain has been set to give an optimal fuel consumption at a certain traffic, the fuel economy will deteriorate at a lower speed traffic since the accelerator is frequently returned and the throttle opening fluctuates frequently due to excessive acceleration of the vehicle. Further at a higher speed traffic, the fuel economy will deteriorate due to excessive depression of the accelerator pedal.

SUMMARY OF THE INVENTION

In view of the foregoing observations and description, the primary object of the present invention is to provide an engine output characteristic control system for a vehicle which can give an optimal fuel consumption according to the running condition of the vehicle.

The control system of the present invention is characterized in that the throttle opening characteristics which determine a target throttle opening for a given amount of depression of the accelerator pedal is set so that the accelerator depression fluctuation rate is minimized when the power mode is selected.

The accelerator depression fluctuation rate is defined to be the ratio of the standard deviation of the accelerator depression to the mean accelerator depression in a predetermined time interval.

In one preferred embodiment of the present invention, the throttle opening characteristics is set so that the accelerator depression fluctuation rate is minimized when the power mode is selected and so that the fuel consumption rate is minimized when the economy mode is selected.

The fuel consumption rate can be represented by the ratio of the integral value of the injector pulse width over a predetermined time interval to the integral value of the vehicle speed over the predetermined time interval.

Since the throttle opening characteristics is set so that the accelerator depression fluctuation rate is minimized when the power mode is selected, the change in the vehicle speed for a given change in the accelerator depression can better conform to the driver's will.

Further since the throttle opening characteristics are set so that the fuel consumption rate is minimized when the economy mode is selected, the fuel consumption performance can be improved while conforming running of the vehicle to the driver's will and the condition of the traffic.

The control system of the present invention can be applied not only to an engine having a throttle valve but also to an engine without a throttle valve like a diesel engine. In the latter case, fuel injection characteristics which determine the amount of fuel to be injected to the engine for a given amount of depression of the accelerator pedal is set so that the accelerator depression fluctuation rate is minimized when the power mode is selected.

DESCRIPTION OF THE PREFERRED EMBODIMENT

Figure 1:
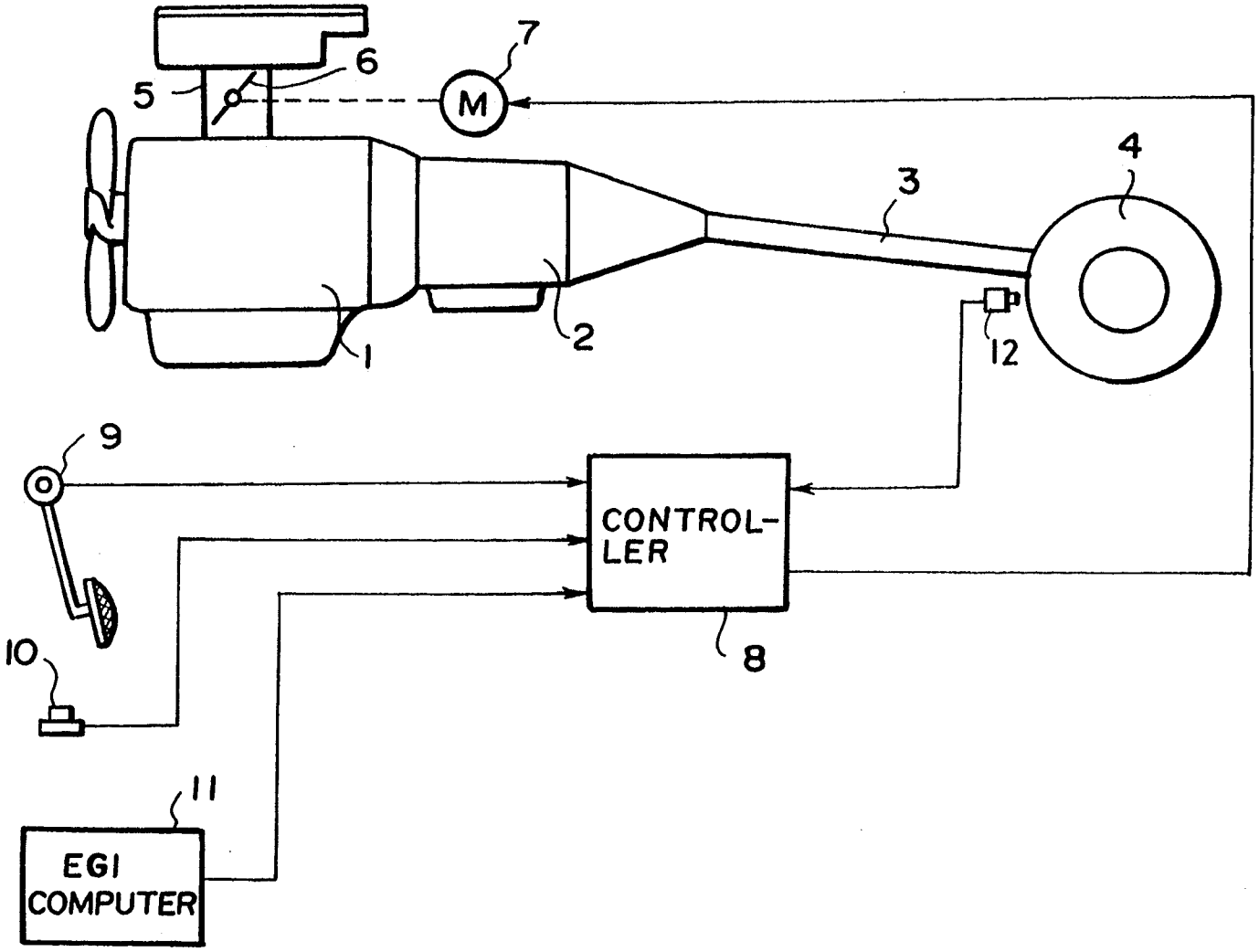
FIG. 1 is a schematic view showing a control system in accordance with an embodiment of the present invention.

In FIG. 1, The output torque of an engine 1 is transmitting to driving wheels 4 through an automatic transmission 2 and a propeller shaft 3. A throttle valve 6 is provided in an intake passage 5 of the engine 1. The throttle valve 6 is opened and closed under the control of a controller 8 by a throttle actuator 7 which may be a DC motor, a stepping motor or the like.

The controller 8 outputs a throttle opening signal TVO to the throttle actuator 7 and controls the throttle valve 6 on the basis of output signals of an accelerator depression sensor 9 which outputs an accelerator depression signal representing the amount of depression of the accelerator pedal, a mode switch 10 which outputs a mode signal M representing the mode selected (the power mode or the economy mode), a computer 11 which calculates the injector pulse width Ip representing the amount of fuel injected from a fuel injector (not shown) and a vehicle speed sensor 12 which outputs a vehicle speed signal Vsp representing the vehicle speed.

Features of the control by the control system of this embodiment will be described, hereinbelow.

(1) Measurement of fuel consumption

The measured fuel consumption rate is fed back and throttle control gains are changed to give an optimal fuel consumption. That is, the fuel consumption rate Qn is represented by the ratio of the integral value Vsp of the vehicle speed over a predetermined time interval to the integral value of the injector pulse width Ip over the predetermined time interval, and a proportional gain Kp and a differential gain Kd for the throttle control are changed according to the fuel consumption rate Qn.

(2) Controlling conditions

A vehicle speed fluctuation rate Vh in a predetermined time interval (e.g., 2 minutes) is set as a value which specifically represents the state of traffic, and an accelerator depression fluctuation rate Ah in a predetermined time interval is set as a value which specifically represents the state of the driver's driving. A state where both the vehicle speed fluctuation rate Vh and the accelerator depression fluctuation rate Ah are smaller than respective predetermined values (e.g., $Vh<10\%$ and $Ah<10\%$) is determined to be a regular state and a learning control on the optimal fuel consumption is effected. The vehicle speed fluctuation rate Vh and the accelerator depression fluctuation rate Ah are defined as follows.

$$Vh=(Vs/Vm)\times 100\%$$

$$Ah=(As/Am)\times 100\%\text{ps}$$

wherein Vs represents the standard deviation of the vehicle speed, Vm represents the mean vehicle speed, As represents the standard deviation of the accelerator depression and Am represents the mean accelerator depression.

(3) Reference value and determination of error

The reference value of the fuel consumption rate is set to be a minimum value (Qmin) in the actual data and the least Qn is constantly set to be Qmin.

The error E is defined as $E=Qmin-Qn$ and the proportional gain Kp and the differential gain Kd are so adjusted that the error E is minimized. A state where the square of the error E is smaller than a constant value Ce is determined to be a state where an optimal fuel consumption is stably obtained, and when such a state is established, the feedback control is interrupted.

(4) Setting optimal initial values

The information on the optimal fuel consumption in one learning control period (the control period in which the control conditions described in the above (2) were satisfied) is stored, and in the next control cycle, the values of the vehicle speed fluctuation rate Vh and the accelerator depression fluctuation rate Ah closest to the values of the vehicle speed fluctuation rate Vh and accelerator depression fluctuation rate Ah detected in the control cycle are selected from the stored values of the vehicle speed fluctuation rate Vh and accelerator depression fluctuation rate Ah and the values of the proportional gain Kp and the differential gain Kd corresponding to the closest values are used as the initial values.

That is, supposing that the following five sets of data (D1 to D5 which are newer in this order) are stored in a certain learning control period and the values of the vehicle speed fluctuation rate Vh and accelerator depression fluctuation rate Ah detected in the next control period are closest to the values Vh4 and Ah4 in the data D4, the values Kp4 and Kd4 are used as the initial values of the proportional gain Kp and differential gain Kd in the control period.

D1(Qmin 1, Vh1, Ah1, Kp1, Kd1)

D2(Qmin 2, Vh2, Ah2, Kp2, Kd2)

D3(Qmin 3, Vh3, Ah3, Kp3, Kd3)

D4(Qmin 4, Vh4, Ah4, Kp4, Kd4)

D5(Qmin 5, Vh5, Ah5, Kp5, Kd5)

(5) Mode compliance economy mode—the values of the proportional gain Kp and differential gain Kd are adjusted to minimize the value of the fuel consumption rate Qn.

power mode—the values of the proportional gain Kp and differential gain Kd are adjusted to minimize the value of the accelerator depression fluctuation rate Ah.

(6) Gain limiter

A limiter which limits the values of the proportional gain Kp and differential gain Kd within a predetermined range in order to ensure a lowest possible running.

(7) Against abnormal values

When the value of the fuel consumption rate Qn for the mean accelerator depression Am is extremely deviated from a standard fuel consumption rate Qs, the value of Qn is regarded as an abnormal value and the values of the proportional gain Kp and the differential gain Kd are not updated.

(8) Against irregular input

Basically this control is effective to a regular running state and if an irregular sharp acceleration of the vehicle occurs, the whole control is adversely affected by a part of the data input at such an acceleration. Accordingly such irregular inputs are rejected. For example, when the maximum accelerator depression Amax in one trip (e.g., for two minutes) is extremely larger than the mean accelerator depression Am, it is determined that an irregular running occurred and the data obtained therein are rejected. Further data obtained in a predetermined time interval (e.g., several seconds) after a depression of the accelerator pedal at a rate (dA/dt) higher than 10% are regarded as momentary data and rejected.

The throttle control routine executed by the controller 8 (FIG. 1) will be first briefly described with reference to the flow chart shown in FIGS. 2 and 3 and then will be described in more detail with reference to the flow chart shown in FIGS. 4 to 10.

Figure 2:
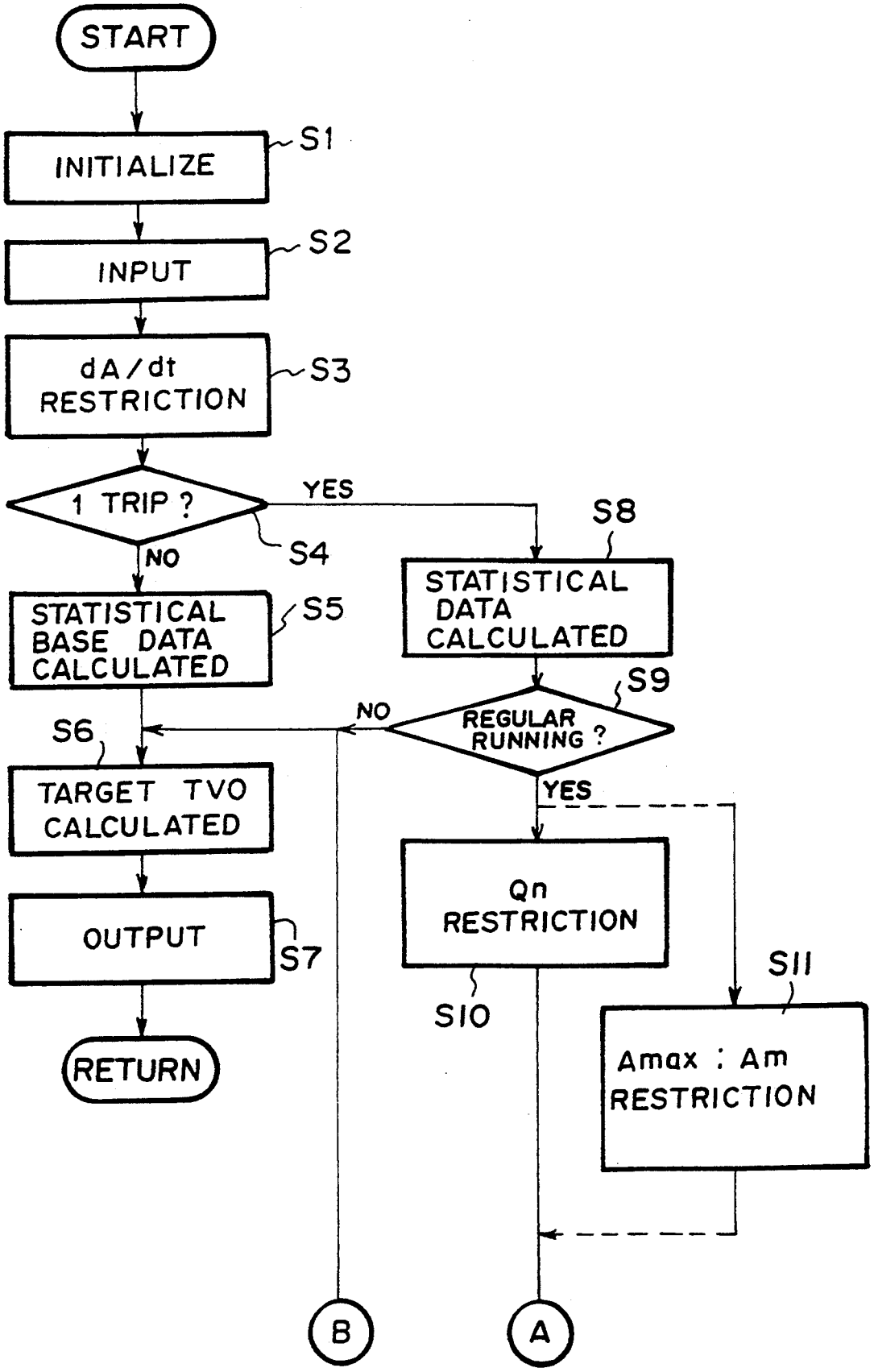
FIG. 2 shows a part of a flow chart for briefly illustrating the throttle control routine executed by the controller shown in FIG. 1.
Figure 3:
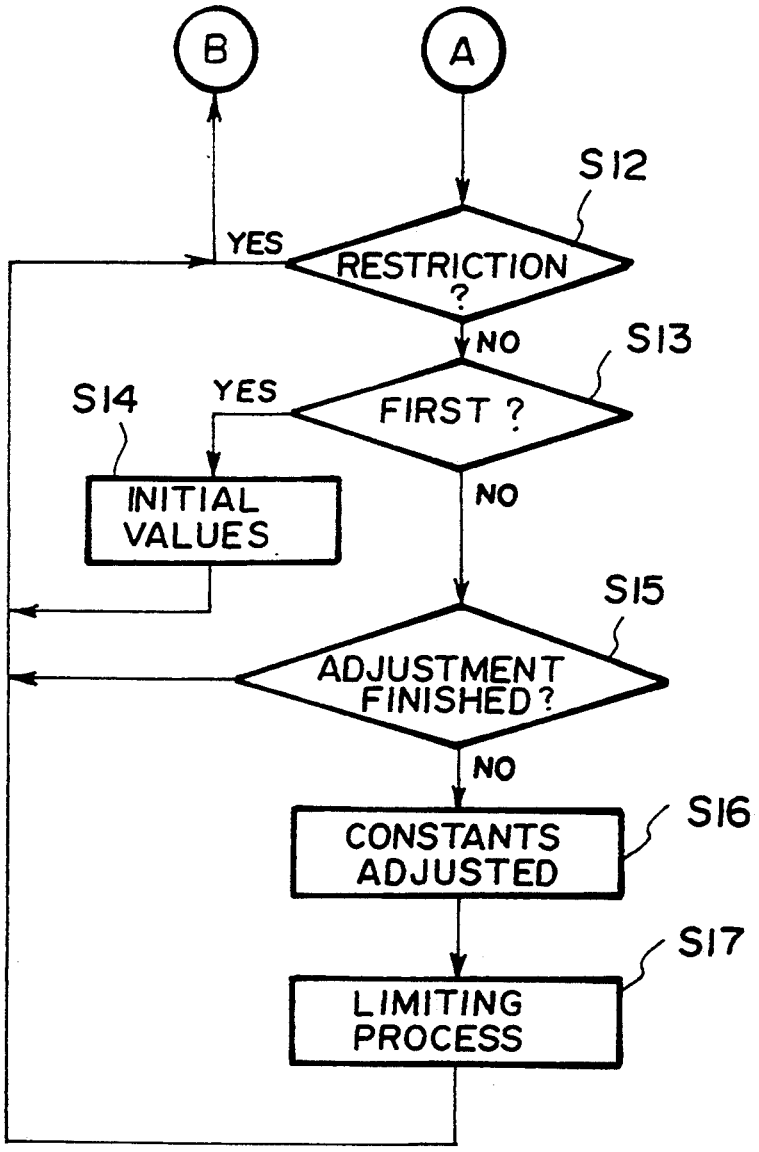
FIG. 3 shows the other part of the flow chart.

Data are initialized in step S1 in FIG. 2 and then the outputs of the sensors are input in step S2. Input restriction related to the accelerator depression rate (the restriction which is made when the accelerator depression rate exceeds 10%) is performed in step S4. Thereafter it is determined whether one trip time (the time interval corresponding to one trip, e.g., 2 minutes) has lapsed. Until one trip time lapses, statistical base data are calculated in step S5, a target throttle opening TVO is calculated in step S6 and the target throttle opening calculated in step S6 is output to the throttle actuator 7 in step S7.

When one trip time lapses, statistical data, i.e., the vehicle speed fluctuation rate Vh, accelerator depression fluctuation rate Ah and fuel consumption rate Qn, are calculated in step S8 and whether the running is a regular running is determined in step S9. When it is determined that the running is not a regular running, step S6 is immediately performed since the data are not updated in this case. When it is determined that the running is a regular running, step S12 in FIG. 3 is performed after input restriction related to the fuel consumption rate is performed (in step S10) or after input restriction related to the maximum accelerator depression Amax versus the mean accelerator depression Am is performed (in step S11).

In step S12, it is determined whether there is any restriction. When it is determined that there is some restriction, step S6 is immediately performed since the data are not updated in such a case. Otherwise it is determined in step S13 whether it is the first control cycle. When it is determined that it is the first control cycle, the initial values are set in step S14 and then step S6 is performed. When it is determined that it is the second or more control cycle, step S15 is performed after step S13. In step S15, it is determined whether the aforesaid adjustment of the proportional gain Kp and the differential gain Kd to minimize the error $E=(Qmin-Qn)^2$ has been finished. If yes, step S6 is performed after step S15, and otherwise, step S6 is performed after the proportional gain Kp and the differential gain Kd are adjusted in step S16 and the aforesaid limiting process for limiting the values of the proportional gain Kp and differential gain Kd within a predetermined range is executed.

Now the operation of the controller 8 which has been briefly described above will be described in more detail with reference to the flow chart shown in FIGS. 4 to 10.

Figure 4:
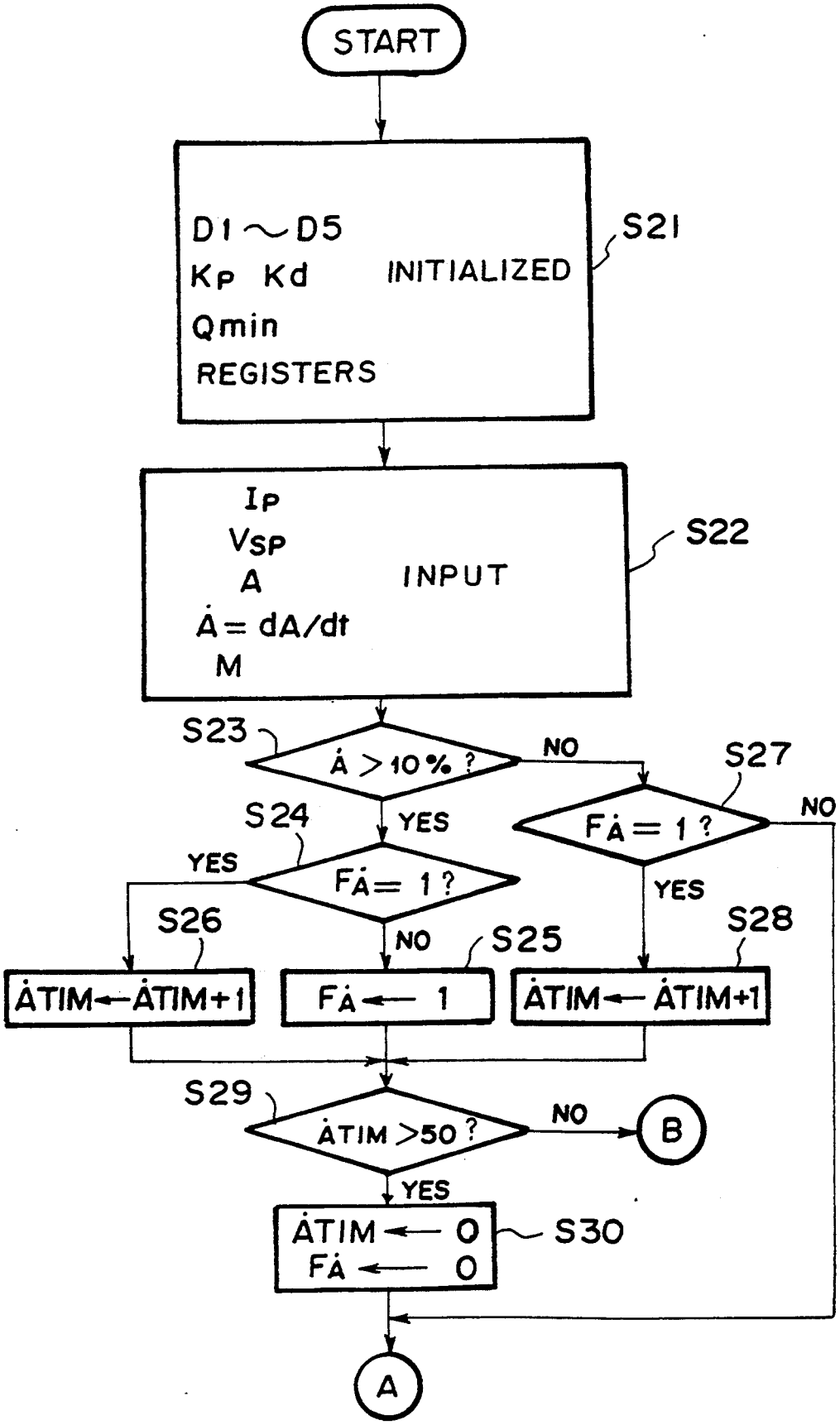
FIG. 4 shows a part of a flow chart for illustrating in detail the throttle control routine executed by the controller shown in FIG. 1.

In FIG. 4, the controller 8 first initializes the data D1 to D5, the proportional gain Kp, the differential gain Kd, the minimum fuel consumption rate Qmin and registers (step S21), and then inputs the injector pulse width Ip, the vehicle speed Vsp, the accelerator depression A, the accelerator depression rate dA/dt and the mode M (step S22). In step S23, the controller 8 determines whether the accelerator depression rate dA/dt has exceeded 10%. When it is determined that the accelerator depression rate dA/dt has exceeded 10%, the controller 8 determines in step S24 whether accelerator depression rate flag $F_A$ has been set to 1. When it is determined that the accelerator depression rate flag $F_A$ has not been set to 1, the controller 8 sets the accelerator depression rate flag $F_A$ to 1 in step S25. In the next flow, when the answer to the question in step S23 is YES, the controller 8 proceeds to step S26 since the answer to the question in step S24 is YES and increments a timer in step S26. When it is determined in step S23 that the accelerator depression rate dA/dt has not exceeded 10%, the controller 8 determines in step S27 whether accelerator depression rate flag $F_A$ has been set to 1. When it is determined that the accelerator depression rate flag $F_A$ has been set to 1, the controller 8 increments a timer in step S28.

Thereafter the controller 8 effects neither data measurement nor calculation and directly proceeds to step S38 (FIG. 5) until 50 control cycles (e.g., 10 seconds) lapses. (step S29) In step S38, the controller 8 calculates a target throttle opening TVO according to formula $TVO=Kp\times A\times Kd\times A$. Then the controller 8 outputs the target throttle opening TVO to the throttle actuator 7. (step S39)

Figure 5:
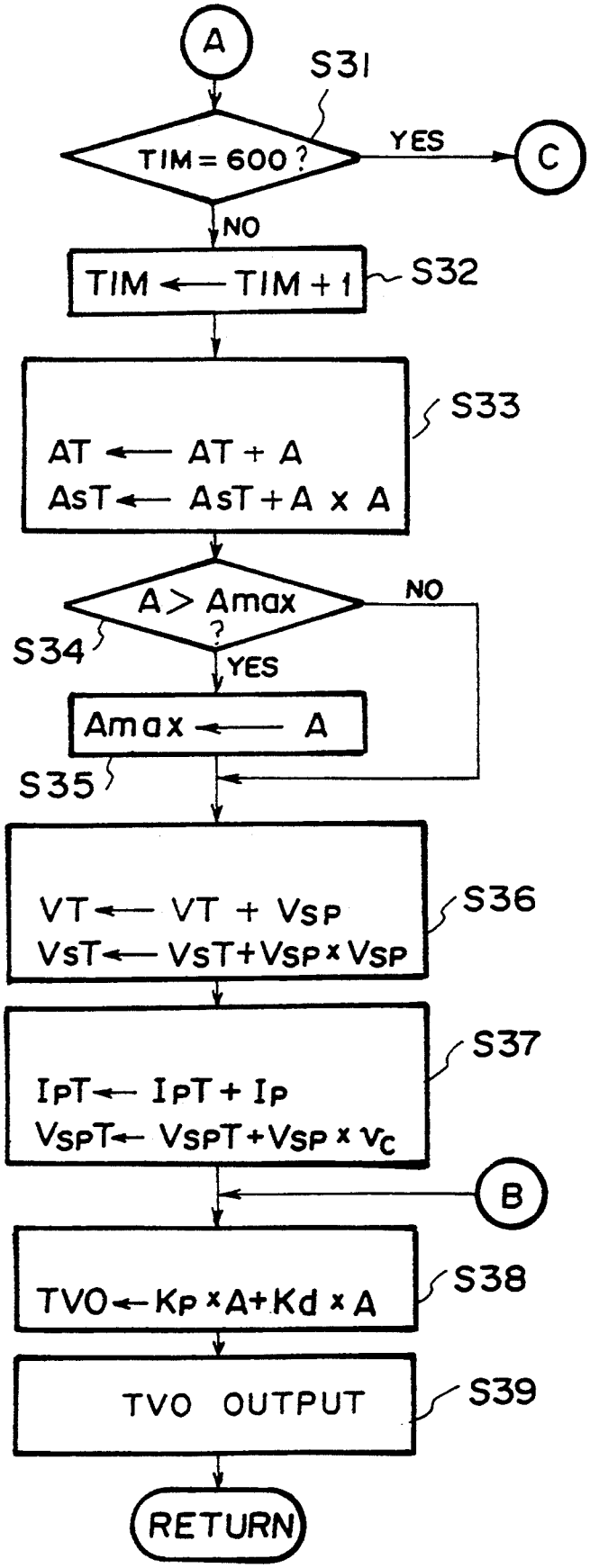
FIG. 5 shows another part of the flow chart.

When the answer to the question in step S29 turns YES, the controller 8 resets the timer and resets the accelerator depression rate flag $F_A$ to 0, and then proceeds to step S31 (FIG. 5). Until 600 control cycles (e.g., 2 minutes) lapses, the controller 8 increments a timer (steps S31 and S32) and calculates the statistical base data AT and AsT for obtaining the mean accelerator depression Am and the standard deviation As of the accelerator depression.

In the next step S34, the controller 8 compares the present accelerator depression A with a maximum accelerator depression Amax (the accelerator depression A which is the largest up to that time) and when the former is larger than the latter, the controller 8 registers the present accelerator depression A in the register for the maximum accelerator depression Amax (step S35).

In step S36, the controller 8 calculates the statistical base data VT and VsT for obtaining the standard deviation Vs of the vehicle speed and the mean vehicle speed Vm. In step S37, the controller 8 calculates the statistical base data IpT and VspT for obtaining the fuel consumption rate Qn. Vc represents a constant for converting the vehicle speed to the distance. Then the controller 8 calculates the target throttle opening TVO in step S38 and then outputs it to the throttle actuator 7 in step S39.

Figure 6:
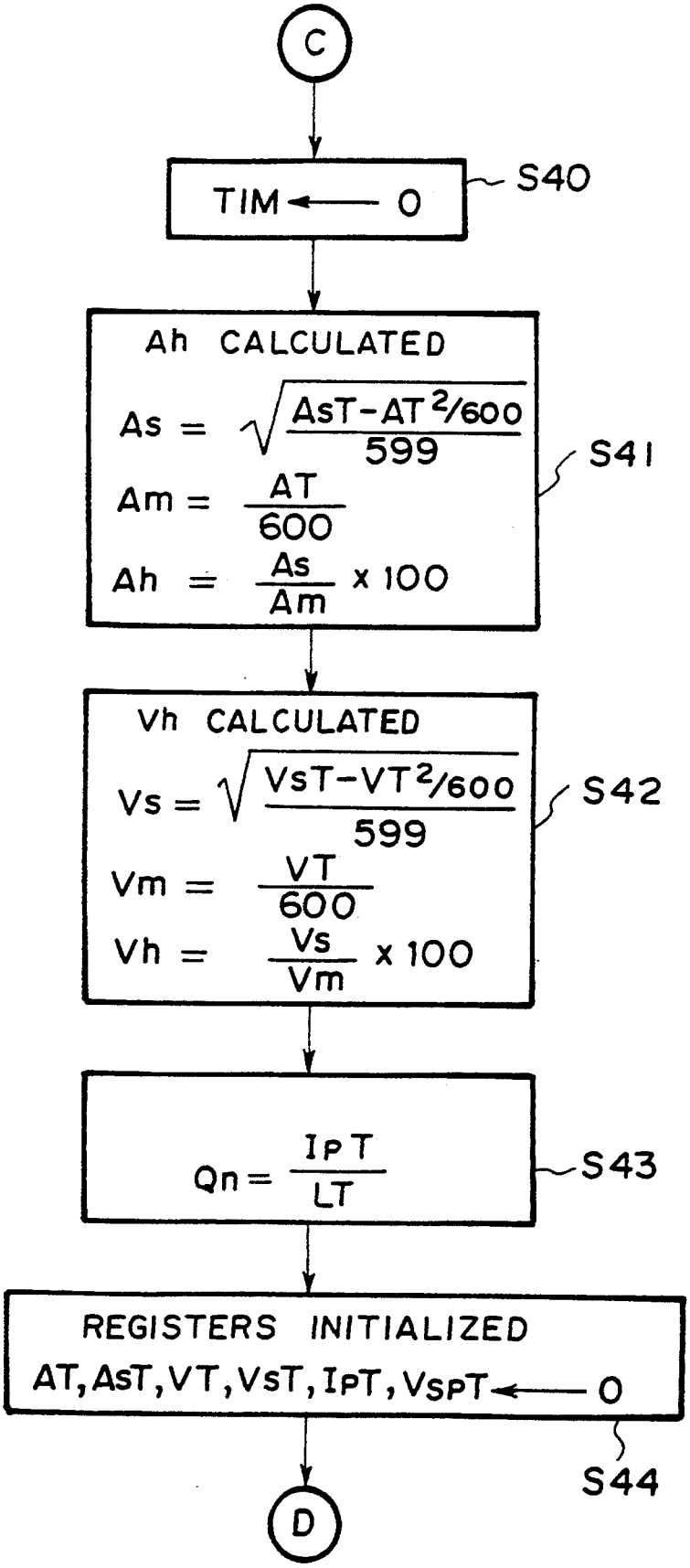
FIG. 6 shows still another part of the flow chart.
Figure 7:
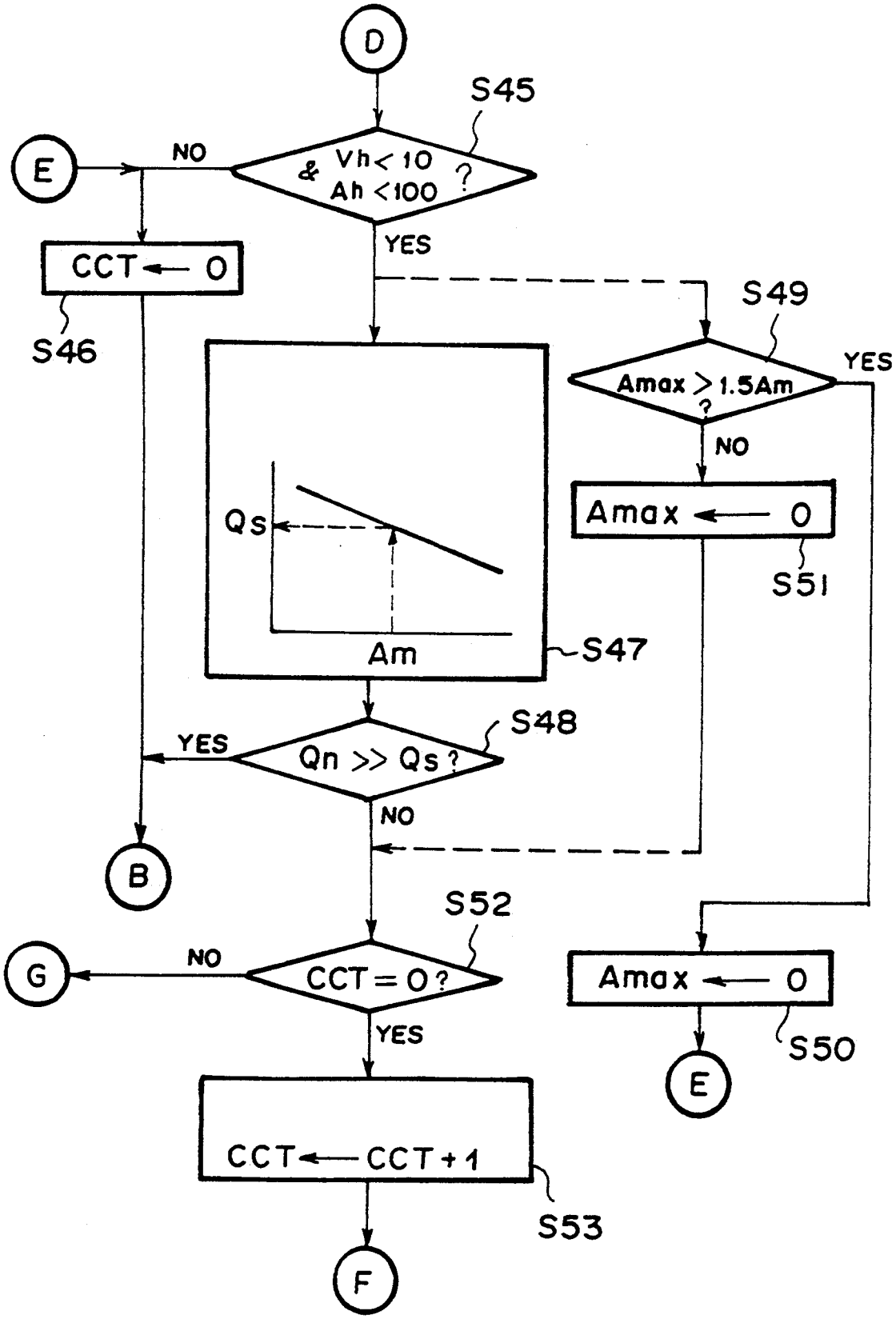
FIG. 7 shows still another part of the flow chart.
Figure 8:
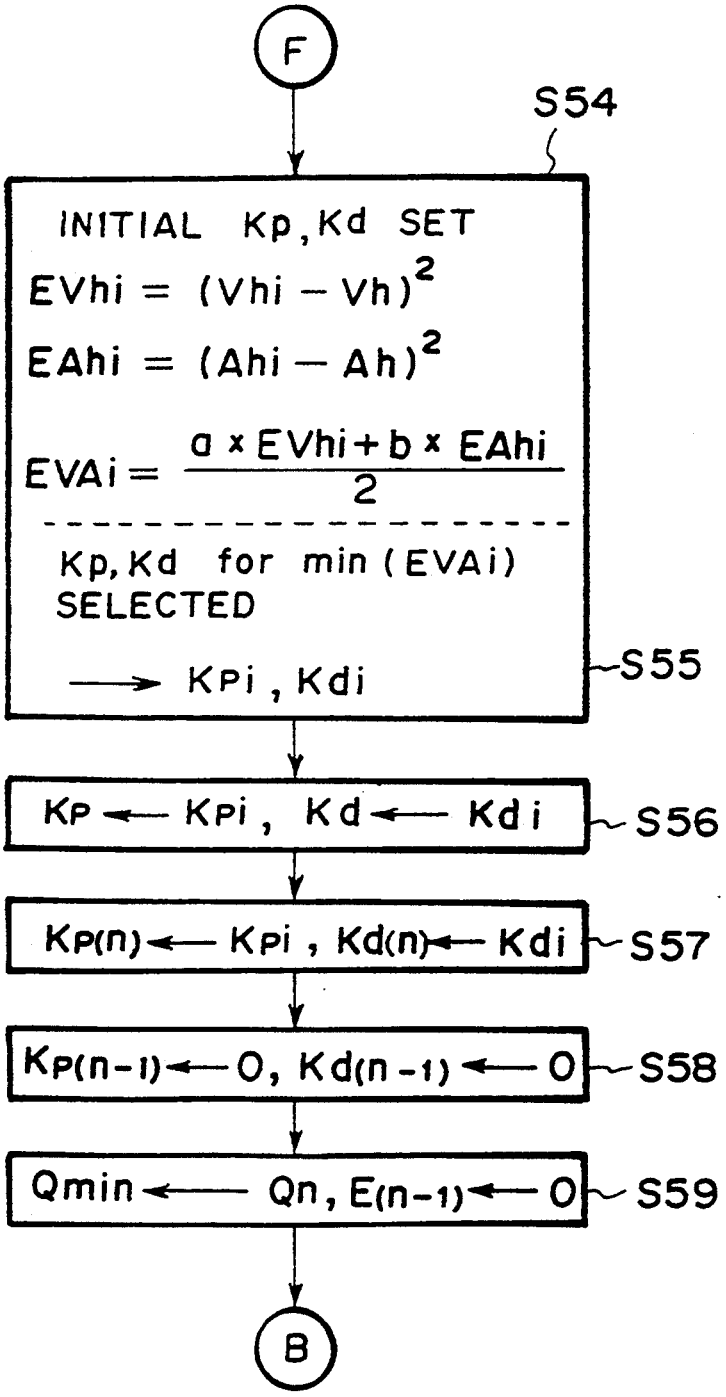
FIG. 8 shows still another part of the flow chart.

When it is determined in step S31 that two minutes has lapsed, the controller 8 proceeds to step S40 in FIG. 6 and resets the timer. In step S41, the controller 8 calculates the standard deviation As of the accelerator depression, the mean accelerator depression Am and the accelerator depression fluctuation rate Ah according to the following formulae.

$$As = \sqrt{(AsT - AT^2/600)/599}$$

$$Am = AT/600$$

-continued $$Ah = (As/Am) \times 100\%$$

The controller 8 calculates in step S42 the standard deviation Vs of the vehicle speed, the mean vehicle speed Vm and the vehicle speed fluctuation rate Vh according to the following formulae.

$$Vs = \sqrt{(VsT - VT^2/600)/599}$$

$$Vm = VT/600$$

$$Vh = (Vs/Vm) \times 100\%$$

Next the controller 8 calculates the fuel consumption rate Qn according to the following formula. (step S43)

Qn=IpT/LT (wherein LT represents the distance the vehicle ran in 2 minutes)

Then in step S44, the controller 8 initializes AT, AsT, VT, VsT, IpT and VspT stored in the register for measurement in preparation for the following control.

In step S45 (FIG. 7), the controller 8 determines whether it is the regular state or the irregular state on the basis of the accelerator depression fluctuation rate Ah and the vehicle speed fluctuation rate Vh respectively calculated in steps S41 and 42. That is, when the vehicle speed fluctuation rate Vh is smaller than 10% and at the same time the accelerator depression fluctuation rate Ah is smaller than 100%, it is determined that it is the regular state, and otherwise it is determined that it is the irregular state. When it is determined that it is the irregular state, the controller 8 initializes a control cycle counter CCT which counts the regular state in step S46 and then proceeds to step S38.

When it is determined in step S45 that it is the regular state, the controller 8 effects protection against abnormal values in steps S47 and 48. That is, the controller 8 searches a map in which the standard fuel consumption rate Qs is related to the mean accelerator depression Am and obtains the value of the standard fuel consumption rate Qs. Then the controller 8 determines in step S48 whether the present fuel consumption rate Qn is extremely larger than the value of the standard fuel consumption rate Qs. When it is determined that the present fuel consumption rate Qn is extremely larger than the value of the standard fuel consumption rate Qs, the controller 8 immediately proceeds to step S38.

Instead of the protection against abnormal values by steps S47 and 48, the controller 8 may effect protection against abnormal values on the basis of the maximum accelerator depression Amax. That is, the controller 8 determines whether the maximum accelerator depression Amax is larger than 1.5 times the mean accelerator depression Am. When it is determined that the former is larger than the latter, the controller 8 proceeds to step S38 after initializing the maximum accelerator depression Amax in step S50 and initializing the control cycle counter CCT in step S46. When it is determined that the former is not larger than the latter, the controller 8 proceeds to step S52 after initializing the maximum accelerator depression Amax in step S51. When it is determined in step S48 that the present fuel consumption rate Qn is not extremely larger than the value of the standard fuel consumption rate Qs, the controller 8 also proceeds to step S52.

In step S52, the controller 8 determines whether the control cycle counter CCT is 0. When it is determined that the control cycle counter CCT is 0, that is, when it is the first control cycle, the controller 8 proceeds to step S54 (FIG. 8) after incrementing the control cycle counter CCT. In step S54, the controller 8 determines initial values of the proportional gain Kp and the differential gain Kd for the throttle control. That is, the controller 8 calculates the difference between the values of the vehicle speed fluctuation rates Vhi in the stored data D1 to D5 and the value of the present vehicle speed fluctuation rate Vh and the difference between the values of the accelerator depression fluctuation rates Ahi and the value of the present accelerator depression fluctuation rate Ah, and calculates the squares EVhi and EAhi of the differences. Then the controller 8 normalizes these EVhi and EAhi by multiplying them by respective correction coefficients a and b, and calculates the averages EVAi of the normalized EVhi and EAhi. Then the controller 8 selects the values (Kpi and Kdi) of the proportional gain Kp and the differential gain Kd corresponding to the smallest of the averages. (step S55) The controller 8 substitutes the Kpi and Kdi for the present values of the proportional gain Kp and the differential gain Kd. (step S56) Further the controller 8 registers the Kpi and Kdi in registers, clears the preceding constants Kp and Kd and initializes a register for detecting the change in the gains. (steps S57 and S58) Then in step S59, the controller 8 substitutes the present fuel consumption rate Qn for a target fuel consumption rate Qmin and clears the preceding deviation E(n−1). Thereafter the controller 8 proceeds to step S38.

Figure 9:
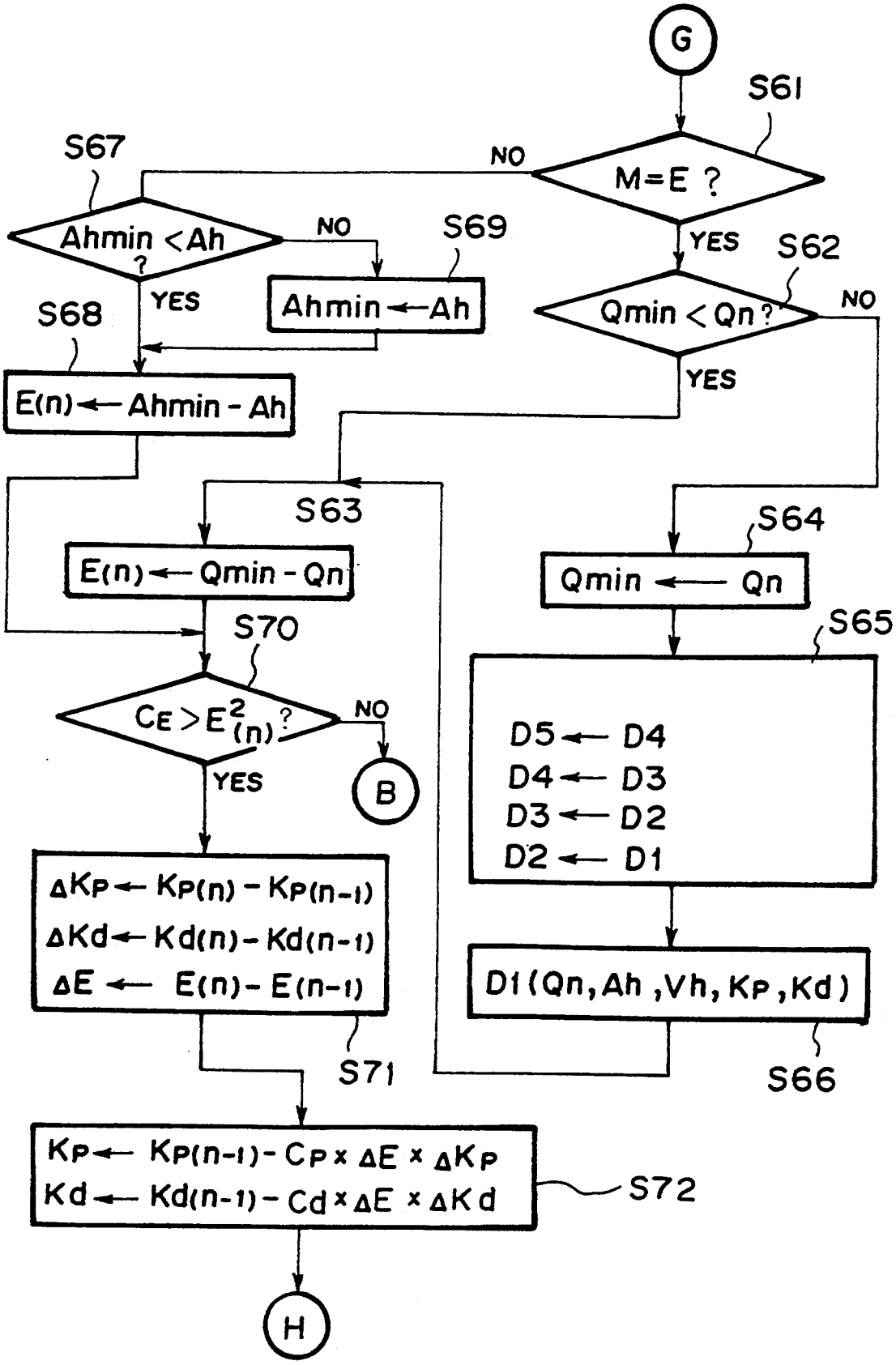
FIG. 9 shows still another part of the flow chart.

When it is determined in step S52 that it is the second or more control cycle, the controller 8 proceeds to step S61 in FIG. 9 and determines which of the economy mode and the power mode has been selected. When it is determined that the economy mode has been selected, the controller 8 effects the control to minimize the fuel consumption rate Qn, and when it is determined that the power mode has been selected, the controller 8 effects the control to minimize the accelerator depression fluctuation rate Ah. That is, when the economy mode has been selected, the controller 8 determines in step S62 whether the present fuel consumption rate Qn is larger than the target fuel consumption rate Qmin. When it is determined that the former is larger than the latter, the controller 8 calculates the deviation E(n) of the present fuel consumption rate Qn from the target fuel consumption rate Qmin in step S63 and then proceeds to step S70.

On the other hand, when it is determined in step S62 that the present fuel consumption rate Qn is not larger than the target fuel consumption rate Qmin, the controller 8 substitutes the present fuel consumption rate Qn for the target fuel consumption rate Qmin in step S64, and makes a rotation of the stored data D1 to D5 to renew the data for initial setting. (steps S64 and S65) In step S66, the controller 8 inserts as the newest data D1 a set of constants the Qn of which is the smallest. Then the controller 8 proceeds to step S63.

When it is determined in step S61 that the power mode has been selected, the controller 8 proceeds to step S67 and determines whether the present accelerator depression fluctuation rate Ah is larger than a target accelerator depression fluctuation rate Ahmin. When it is determined that the former is larger than the latter, the controller.8 calculates the deviation E(n) of the present accelerator depression fluctuation rate Ah from the target accelerator depression fluctuation rate Ahmin in step S68 and then proceeds to step S70. On the other hand, when the former is not larger than the latter, the controller 8 proceeds to step S68 after substituting the present accelerator depression fluctuation rate Ah for the target accelerator depression fluctuation rate Ahmin in step S69.

In step S70, the controller 8 compares the square of the deviation E(n) calculated in step S63 or S68 with a predetermined deviation value $C_E$ and when the former is not smaller than the latter, the controller 8 considers that the adjustment has been finished and proceeds to step S38 in FIG. 5.

On the other hand, when the former is smaller than the latter, adjustment of the proportional gain Kp and the differential gain Kd is effected. That is, the controller 8 calculates the differences between the present value and the preceding value of the proportional gain Kp, between the present value and the preceding value of the differential gain Kd and between the present value and the preceding value of the deviation E (step S71) and then determines the proportional gain Kp and the differential gain Kd according to the following formulae (step S72).

$$Kp=Kp_{(n-1)}-Cp\times\Delta E\times\Delta Kp$$

$$Kd=Kd_{(n-1)}-Cd\times\Delta E\times\Delta Kd$$

wherein Cp and Cd are constants which determine the degree of adjustment. As can be understood from the above formulae, when both ΔKp and ΔE increase, the proportional gain Kp decreases.

Figure 10:
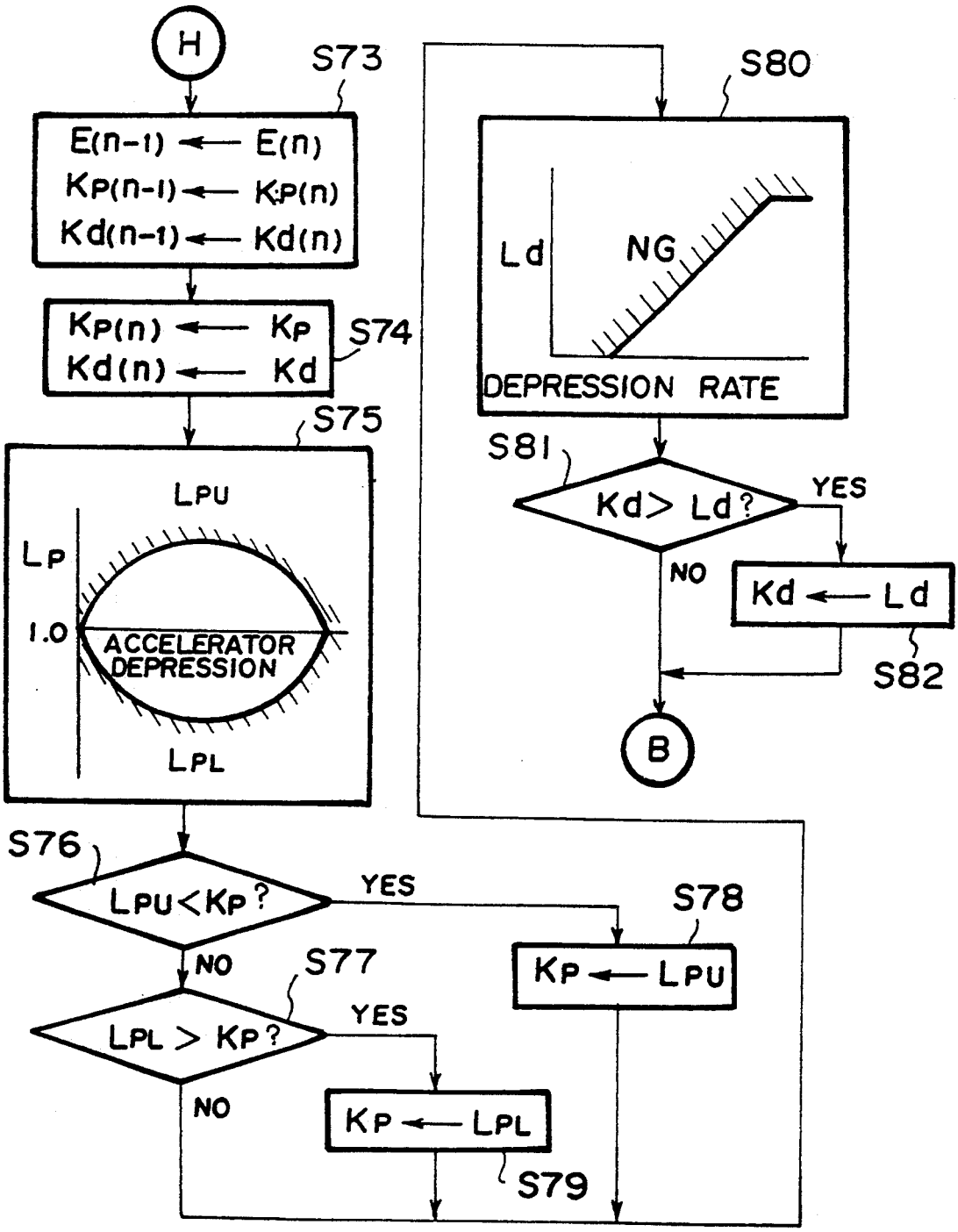
FIG. 10 shows the other part of the flow chart.

Then in step S73 in FIG. 10, the controller 8 renews the data for calculating the gains. That is, the controller 8 substitutes the present deviation $E_{(n)}$ for the preceding deviation $E_{(n-1)}$ and the present gains $Kp_{(n)}$ and $Kd_{(n)}$ respectively for the preceding gains $Kp_{(n-1)}$ and $Kd_{(n-1)}$. Further in step S74, the controller 8 renews the data. The controller 8 searches a limiter map in which the permitted limit of the proportional gain Kp is related to the accelerator depression, and determines whether the proportional gain Kp is larger than the upper limit $L_{PU}$ and whether the proportional gain Kp is smaller than the lower limit $L_{PL}$ (steps S75, S76 and S77). When the proportional gain Kp is not larger than the upper limit $L_{PU}$ and not smaller than the lower limit $L_{PL}$, the controller 8 directly proceeds to step S80. However when the proportional gain Kp is larger than the upper limit $L_{PU}$, the controller 8 substitutes the upper limit $L_{PU}$ for the proportional gain Kp in step S78 and then proceeds to step S80, and when the proportional gain Kp is smaller than the lower limit $L_{PL}$, the controller 8 substitutes the lower limit $L_{PL}$ for the proportional gain Kp in step S79 and then proceeds to step S80.

In step S80, the controller 8 searches a limiter map in which the upper limit Ld of the differential gain Kd is related to the accelerator depression rate, and in step S81, the controller 8 determines whether the differential gain Kd is larger than the upper limit Ld. When the former is not larger than the latter, the controller 8 directly proceeds to step S38 and otherwise the controller 8 substitutes the upper limit Ld for the differential gain Kd in step S82 and then proceeds to step S38. The controller 8 calculates the target throttle opening TVO in step S38 and outputs it to the throttle actuator 7 in step S39.

As can be understood from the description above, in the control system of this embodiment, the control gains Kp and Kd are set so that the accelerator depression fluctuation rate is minimized when the power mode is selected and the fuel consumption rate is minimized when the economy mode is selected. Accordingly, improvement of the running performance in the power mode and improvement of the fuel economy in the economy mode can be realized with an optimal fuel consumption according to the running condition of the vehicle.

Further throttle valve can be optimally controlled according to the condition of the traffic and the fuel economy can be improved when the traffic is substantially constant and the driver does not want to change the running of the vehicle.

What is claimed is:

1. An engine output characteristic control system for a vehicle comprising an accelerator depression detecting means which detects the amount of depression of the accelerator pedal, an engine output regulating means which controls the output of the engine in response to movement of an accelerator pedal, an engine output characteristic setting means for setting engine output characteristics which determine a target engine output for a given amount of depression of the accelerator pedal, and a controller which causes the engine output regulating means to control the engine output to a target engine output determined according to the engine output characteristics on the basis of the amount of depression of the accelerator pedal detected by the accelerator depression detecting means, wherein said engine output characteristic setting means sets the engine output characteristics in response to a demand for higher running performance so that the accelerator depression fluctuation rate is minimized, estimates the actual fuel consumption rate, and changes the throttle control gain so that the estimated actual fuel consumption rate converges on a target value.

2. An engine output characteristic control system as defined in claim 5 in which said engine output characteristic setting means calculates the vehicle speed fluctuation rate and the accelerator depression fluctuation rate in each control period, and when both the vehicle speed fluctuation rate and the accelerator depression fluctuation rate are smaller than respective predetermined values, the engine output characteristic setting means stores the vehicle speed fluctuation rate, the accelerator depression fluctuation rate and the fuel consumption rate together with the control gains in the control period and sets the initial values of the control gains in the following control period to the values of the control gains in the stored data corresponding to the accelerator depression fluctuation rate and the fuel consumption rate closest to those in said following control period.

3. An engine output characteristic control system as defined in claim 2 in which said control gain is reduced when the actual fuel consumption rate is smaller than a predetermined value.

4. An engine output characteristic control system as defined in claim 1 in which said control gain is reduced when the actual fuel consumption rate is smaller than a predetermined value.

5. An engine output characteristic control system for a vehicle comprising an accelerator depression detecting means which detects the amount of depression of the accelerator pedal, a throttle actuator which opens and closes the throttle valve, a throttle opening characteristic setting means for setting throttle opening characteristics which determine a target throttle opening for a given amount of depression of the accelerator pedal, and a controller which causes the throttle actuator to control the throttle opening to a target throttle opening determined according to the throttle opening characteristics on the basis of the amount of depression of the accelerator pedal detected by the accelerator depression detecting means, wherein said throttle opening characteristic setting means sets the throttle opening characteristics in response to a demand for higher running performance so that the accelerator depression fluctuation rate is minimized, as well as in response to a demand for better fuel economy so that the fuel consumption rate is minimized, and said throttle opening characteristic setting means estimates the actual fuel consumption rate and changes the throttle control gain so that the estimated actual fuel consumption rate converges on a target value.

6. An engine output characteristic control system as defined in claim 5 in which said throttle opening characteristic setting means calculates the vehicle speed fluctuation rate and the accelerator depression fluctuation rate in each control period, and when both the vehicle speed fluctuation rate and the accelerator depression fluctuation rate are smaller than respective predetermined values, the throttle opening characteristic setting means stores the vehicle speed fluctuation rate, the accelerator depression fluctuation rate and the fuel consumption rate together with the control gains in the control period and sets the initial values of the control gains in the following control period to the values of the control gains in the stored data corresponding to the accelerator depression fluctuation rate and the fuel consumption rate closest to those in said following control period.

7. An engine output characteristic control system as defined in claim 6 in which said control gain is reduced when the actual fuel consumption rate is smaller than a predetermined value.

8. An engine output characteristic control system as defined in claim 5 in which said control gain is reduced when the actual fuel consumption rate is smaller than a predetermined value.

9. An engine output characteristic control system for a vehicle comprising an accelerator depression detecting means which detects the amount of depression of the accelerator pedal, a throttle actuator which opens and closes a throttle valve of the engine, a throttle opening characteristic setting means which determines a target throttle opening for a given amount of depression of the accelerator pedal, a means for detecting an accelerator depression fluctuation rate based on the amount depression of the accelerator pedal, and a controller which causes the throttle actuator to control the throttle opening to a target throttle opening determined according to the throttle opening characteristics on the basis of the amount of depression of the accelerator pedal detected by the accelerator depression detecting means, wherein said throttle opening characteristic setting means sets a control gain of the engine output characteristics based on the accelerator depression fluctuation so that the accelerator depression fluctuation rate is minimized.

10. An engine output characteristic control system as defined in claim 9 in which said control gain is increased when the accelerator depression fluctuation rate is higher than a predetermined value.

11. An engine output characteristic control system for a vehicle comprising an accelerator depression detecting means which detects the amount of depression of the accelerator pedal, a throttle actuator which opens and closes the throttle valve, a throttle opening characteristic setting means for setting throttle opening characteristics which determine a target throttle opening for a given amount of depression of the accelerator pedal, means for estimating an actual fuel consumption rate; and a controller which causes the throttle actuator to control the throttle opening to a target throttle opening determined according to the throttle opening characteristics on the basis of the amount of depression of the accelerator pedal, detected by the accelerator depression detecting means, wherein said throttle opening characteristic setting means sets the throttle opening characteristics by changing a throttle control gain on the basis of the actual fuel consumption rate so that the actual fuel consumption rate converges on a target valve.

12. An engine output characteristic control system as defined in claim 11 in which said control gain is reduced when the actual fuel consumption rate is smaller than a predetermined value.

13. An engine output characteristic control system for a vehicle comprising an accelerator depression detecting means which detects the amount depression of the accelerator pedal, an engine output regulator, an engine output regulating characteristic setting means for setting engine output regulating characteristic which determine a target engine output for a given amount of depression of the accelerator pedal, a means for detecting an accelerator depression fluctuation rate based on the amount of depression of the accelerator pedal, and a controller which causes the engine output regulator to control the engine output to a target engine output determined according to the engine output characteristic on the basis of an amount of depression of the accelerator pedal detected by the accelerator depression detecting means, wherein said engine output characteristic setting means sets a control gain of the engine output characteristics based on the accelerator depression fluctuation so that the accelerator depression fluctuation rate is minimized.

14. An engine output characteristic control system as defined in claim 13 in which said control gain is increased when the accelerator depression fluctuation rate is higher than a predetermined value.

15. An engine output characteristic control system for a vehicle comprising an accelerator depression detecting means which detects the amount of depression of the accelerator pedal, an engine output regulator, an engine output regulating characteristic setting means for setting engine output regulating characteristics which determine a target engine output for a given amount of depression of the accelerator pedal, means for estimating an actual fuel consumption rate, and a controller which causes the engine output regulator to control the engine output to a target engine output determined according to the engine output characteristics on the basis of the amount of depression of the accelerator pedal detected by the accelerator depression detecting means, wherein said engine output characteristic setting means sets the engine output characteristics on the basis of the actual fuel consumption rate so that the actual fuel consumption rate converges on a target value.

16. An engine output characteristic control system as defined in claim 15 in which said control gain is reduced when the actual fuel consumption rate is smaller than predetermined value.

* * * * *